United States Patent [19]

Holmes et al.

[11] 4,409,111

[45] Oct. 11, 1983

[54] ANTI-GALLING LUBRICATIVE COMPOSITION

[75] Inventors: Mark Holmes, Quaker Hill; Elliott Frauenglass, Newington, both of Conn.

[73] Assignee: Loctite Corporation, Newington, Conn.

[21] Appl. No.: 367,695

[22] Filed: Apr. 12, 1982

[51] Int. Cl.[3] ..... C10M 3/48; C10M 3/22

[52] U.S. Cl. ..... 252/30; 250/49.3; 250/49.5; 250/49.7

[58] Field of Search ..... 252/26, 29, 30, 49.3, 252/49.5, 49.7

[56] References Cited

U.S. PATENT DOCUMENTS 4,303,537 12/1981 Laepple et al. ..... 252/30

4,313,836 2/1982 Nassry et al. ..... 252/49.5

FOREIGN PATENT DOCUMENTS 2036071 6/1980 United Kingdom ..... 252/30

*Primary Examiner*—Jacqueline V. Howard

*Attorney, Agent, or Firm*—Eugene F. Miller; J. Rodney Reck

[57] ABSTRACT

A preapplied, non-migratory, anti-galling composition, capable of retaining excellent lubricating properties up to temperatures of about 1200° F. for an extended period of time, comprising an aqueous dispersion of graphite powder or metal powder, or both, in a polymeric binder. The composition is especially useful for providing a lubricating agent for metallic threaded objects to be subjected to high temperatures.

6 Claims, No Drawings

ANTI-GALLING LUBRICATIVE COMPOSITION

BACKGROUND AND SUMMARY OF THE INVENTION

Heretofore, anti-galling compositions containing solid lubricants such as nickel and graphite have been well known in the art as useful on various metal surfaces at elevated temperatures. These compositions are generally oil based and tend to migrate once applied, creating imprecise application and inconvenient and messy handling. Because these compositions tend to migrate, they often come in contact with areas of a part which should be kept free of lubricating materials. The use of these compositions on numerous applications where cleanliness, precision and speed are required, is precluded due to their unmanageable nature.

Other prior art dry lubricants have been developed in conjunction with electrolytic plating techniques. For example, U.S. Pat. No. 3,756,925 to Takeuchi et al., describes a dry lubricant coating comprising a graphite flouride powder, which is just treated with a dispersion promoter, and then immersed in a metal plating bath. The graphite flouride dispersion is then deposited electrolytically onto a surface as a lubricative coating.

Various combinations of graphite and molybdenum disulphide have been known to be effective lubricative coatings. U.S. Pat. No. 4,243,434, to Hartley, describes such a combination dispersed in an aqueous phosphate metal binder. These coatings are useful in prolonging the useful life of cutting tools and other such objects subject to high abrasive contact.

Lubricative compositions containing molybdenum are not effective in applications involving threads (e.g. nuts and bolts assemblies) where lubricity is required to facilitate the turning of a nut on a bolt or a bolt into a flange. Molybdenum is a hard, dense material which tends to resist compression. This interferes with the torquing-on of a nut onto a bolt, thereby increasing the amount of torque required to seat the nut against the flange.

Similarly, disassembly of a nut, the threads of which are coated with molybdenum, demonstrates the same problem, particularly after a nut and bolt assembly has been loaded to a particular tension and exposed to extreme temperature conditions, e.g., between 800°-1200° F. Seizing and galling of the threads are frequent with such compositions.

It is evident that a need exists which overcomes the deficiencies of the prior art, yet maintains all its advantages. The instant invention is a dry-to-the-touch, non-migratory, high temperature, anti-galling and lubricating composition which can be applied to a surface, particularly a metal surface, via any suitable method, e.g., dipping, painting, rolling, spraying, etc., and which retains its lubricative properties at temperatures up to 1200° F.

The composition comprises a dispersion or suspension of graphite powder or metal powder, or both, in an aqueous carrier containing a polymeric binder, said graphite powder being present in the amounts of about 5% to about 70%, and said metal powder being present in the amounts of about 0% to about 90%. Percents are based on the weight of the total composition.

This invention also relates to a process of coating a surface with a dry, non-migratory coating, as well as to a threaded object coated with the disclosed composition.

DETAILED DESCRIPTION AND PREFERRED EMBODIMENTS

The instant invention concerns a preapplied, anti-galling, lubricative composition comprising a dispersion or suspension of graphite powder or metal powder, or both, in an aqueous polymeric binder. Additionally, the invention relates to a method of applying an anti-galling, lubricative composition to a part. Furthermore, a threaded object coated with the disclosed composition is contemplated.

The compositions of this invention are intended to solve the galling and seizing problems associated with threaded parts, such as nuts and bolts, when exposed to extremely high temperatures. The essence of the invention is a composition and means of providing the anti-galling and lubricative capabilities of the prior art, without its disadvantages of migration and smearing. The instant compositions comprise a dispersion or suspension of graphite powder or metal powder, or both, in an aqueous carrier comprising a polymeric binder, said graphite powder being present in the amounts of about 5% to about 70%, and said metal powder being present in the amounts of about 0% to about 90%. For convenience, all percentages hereinafter are based on the weight of the total composition, unless otherwise specified.

The polymeric binder can be virtually any water-soluble polymeric binder in which a stable suspension or dispersion with the lubricating powders can be formed. One particular polymeric binder which was found to be most suitable, and is therefore most preferred, is polyvinyl alcohol. Ordinarily, an aqueous solution of polyvinyl alcohol is present in the anti-galling lubricative composition in the amounts of about 10% to about 80%, the preferred range being in the range of about 35% to about 75%. The polymer-containing aqueous solution is generally one with about 3% to about 15% of polymeric binder. The preferred content of polyvinyl alcohol is about 5% to about 7% based on the total weight of the aqueous solution.

Other metal powders have been found to be useful in the instant compositions. Although copper and aluminum powders have provided viable anti-galling, lubricative compositions when combined with the aqueous polymeric binder, they have not produced as surprisingly excellent results as graphite or nickel powders, either alone or in combination with each other. They are, however, useful in the instant compositions for a variety of high temperature applications.

A variety of optional, but recommended, functional additives well known in the art can be employed in any reasonable manner to produce desired characteristics. For example, thickeners, plasticizers, diluents, anti-bacterial agents and fungicides may be added to modify the composition without changing its essential nature.

The composition may be applied by any conventional method onto a part. Once the composition is deposited onto a part, the water is allowed to evaporate, leaving behind a dry-to-the-touch polymeric, lubricative film. The part can be stored until used without any migration or smearing of the lubricative powders. Ordinarily a part, particularly a threaded object such as a nut or bolt, is dipped, sprayed or painted with the disclosed composition. Heat may be used to accelerate water loss and obtain a dry coating on the part. Alternatively, water evaporation may occur at room temperature.

In many applications where the composition is to be used on threaded parts such as nuts and bolts, it is desirable that a specific torque-tension relationship be maintained. In nearly every case, the purpose of using a nut and a bolt is to provide a specific clamping force. It is important to be able to predict the necessary torque that will be required to achieve a specified clamping force, as well as how long the nut and bolt assembly will stay at that value. At sometime during the life of the nut and bolt, it may be desirable to remove the clamping force by disassembling the nut and bolt.

To tighten an engaged nut and bolt, one applies torque normally in a clockwise direction to the head of the bolt or the nut. In many cases, the nut will be tightened until it is seated against a flange. At this point, the bolt will continue to rotate until a balance is obtained between the torque applied to the head and the sum of the bolt tension and friction. This equilibrium relationship is often expressed mathematically in the equation:

$$T=KDF$$

Where

T=Torque, inch pounds (in-lb) or foot pounds (ft-lb)

D=Nominal diameter of bolt, inches

F=Induced force or clamp load, lbs (pounds)

K=An empirical constant which takes into account friction and the variable diameter under the head and in the threads where friction is acting. (It is not the coefficient of friction although it is related to it.)

The variation in friction and therefore, in the K value, is dependent upon the nature of the surfaces in contact with each other, the size of the bolts, and the type of lubricant or thread treating material present, if any.

In the applications where the threaded parts are subjected to high temperatures, and subsequent thermal expansion, it is desirable to apply a lubricant to the threads. The lubricative composition chosen must be one that does not significantly impede the threading-on of the bolt, yet one that prevents the galling and seizing of the threads after high temperatures and extreme loads have been applied. In applications where the temperature reaches 1000° F. or more, galling of mating threaded parts is common.

The instant invention does not significantly impede the assembly of threaded parts; that is, the amount of torque necessary to seat a nut against a flange is reasonably low. Additionally, the torque required to remove the nut from the bolt after a high temperature, high load has been applied, is also as low or lower than the lubricative compositions of the prior art. The distinct advantage of the instant invention over the prior art is that its ability to provide good lubricity in assembly and disassembly at high temperatures is combined with the ability to be preapplied. Additionally, the compositions do not significantly contribute to a reduction in clamping force once a bolt has been torqued and seated at a desired tension.

This invention will be further appreciated by the examples to follow. These examples are not meant to restrict the effective scope of the invention.

EXAMPLE 1

The following formulation, representing a composition within the scope of this invention was prepared.

TABLE I

| Ingredient | % by wt. of the total composition |
|---|---|
| water | 42.54 |
| polyvinyl alcohol | 2.67 |
| thickener | 2.41 |
| graphite | 26.12 |
| nickel | 26.12 |
| antibacterial agent | 0.14 |

This composition was applied to grade 5—3/18-16 degreased steel nuts and bolts. The composition was allowed to sit at room temperature to dry. The coating was dry-to-the-touch and filled the threads of the bolt and nut. The nuts and bolts were mated through a flange assembly and the nut was seated to a pretorqued value of 30 ft-lbs. They were then heated in an oven for 24 hrs. at 1200° F. The break loose and prevail values were then measured. Break loose is the amount of force, measured in ft-lbs, required to loosen the nut initially. Prevail is the amount of force required to move the nut through a rotation of 180° in the counterclockwise (loosening direction) on a normal thread direction, after it has already been loosened. These measurements are generally very high and can cause failure of parts if galling or seizing of the threads has occurred. The instant compositions produced break loose values of 18–28 ft-lbs, and prevail values of 0–2 ft-lbs. These values are indicative of the lubricative and anti-galling effects that are present in the instant compositions.

The on-torque values for this composition were found to be very low, indicating that the composition does not significantly impede the threading-on of the nut onto the bolt. The composition of Table I was applied to nuts and bolts and the torque required to thread the coated nuts and bolts together was recorded. These on-torque valves are shown in Table II.

TABLE II

| Specimen # | Grade 5 ⅜-16 steel Nut & Bolt - Degreased | Grade 5 ⅜-16 phosphate & oil - as received |
|---|---|---|
| 1 | 7½ in - lbs | 25 in - lbs |
| 2 | 3 in - lbs | 12 in - lbs |
| 3 | 4½ in - lbs | 27½ in - lbs |
| 4 | 8 in - lbs | 13 in - lbs |
| 5 | 4½ in - lbs | 10 in - lbs |

Torque values were recorded for ten 360° turns on the nut onto the bolt and the maximum torque value for each turn was used to obtain the average. Thus, the values given above in inch-pounds represent the average maximum of ten 360° turns.

EXAMPLE 2

The composition of Example 1 was applied to phosphate and oil (hereinafter "phos & oil"), as well as steel nuts and bolts. The nuts were seated to a 250 in-lb load and heated for 24 hrs. at 1200° F. The samples were then cooled to room temperature and the break loose was measured (see Table III).

TABLE III

| Specimen # | Phos & Oil Grade 5 ⅜-16 - as received | Steel Grade 5 ⅜-16 degreased |
|---|---|---|
| 1 | 94 in - lbs | 130 in - lbs |
| 2 | 102 in - lbs | 165 in - lbs |
| 3 | 112 in - lbs | 145 in - lbs |

Once the nut was moved initially, e.g., the break loose being measured, the nut could be easily turned-off by hand. This indicates that no galling or seizing of the threads had occurred and that the composition provided an effective lubricative effect.

EXAMPLE 3

The composition of Example 1 was applied to nuts and bolts of the same size and grade as in the previous examples, and an average maximum on-torque value was measured for each. The nut was turned 360° several times and the maximum on-torque in inch-pounds was recorded. The purpose of this test was to determine the difficulty involved, if any, in threading the nut onto a bolt which had been coated with the composition.

TABLE IV

| Specimen # | Phos & Oil | Steel |
|---|---|---|
| 1 | 26 in - lbs after 8 turns | 6 in - lbs after 9 turns |
| 2 | 28 in - lbs after 8 turns | 12 in - lbs after 8 turns |

This example indicates the ease with which a nut can be threaded onto the bolt which is coated with the composition.

EXAMPLE 4

The following example demonstrates the effectiveness of the instant compositions as lubricating agents. The composition of Example 1 was used to coat grade 5, 3/8-16 phos and oil, and steel nuts and bolts. Using a torque-tension testing machine, a torque-tension plot was made. This measurement plotted a graph of torque versus tension, showing the amount of torque required to seat the nut against a bearing surface to a desired tension. The torque required to obtain a specified tension should be less than an uncoated bolt if the lubricating agent is effective. The nut was torqued only to 75% of its proof load, to be sure not to reach the yield point of the metals. From a torque-tension graph, the average K values can be computed using the formula T=KDF. Tables V and VI below give the results of these tests.

TABLE V

| Steel Nut & Bolt - 75% of Proof Load = 4950 lbs | Coated | Uncoated |
|---|---|---|
| *Average Torque required to reach 4950 lbs. tension | 192 in - lbs | 232 in - lbs |
| *Average K value range | 0.097–0.113 | 0.119–0.13 |

*Averages were computed from five specimens.

TABLE VI

| Phos & Oil Nut & Bolt - 75% of Proof Load ≐ 950 lbs. | Coated | Uncoated |
|---|---|---|
| Average Torque required to reach 4950 lbs. tension | 195 in - lbs | 218 in - lbs |
| Average K value range | 0.09–0.12 | 0.113–0.121 |

As seen from the tables, the instant compositions provide lubrication to the threaded parts, which means less applied torque is required to reach a specified tension compared to an uncoated bolt. Thus, lubricating as well as anti-galling is achieved.

We claim:

1. A preapplied, lubricating composition consisting essentially of a dispersion or suspension of graphite powder or a metal powder selected from the group consisting of nickel, copper or aluminum, or any mixture of the foregoing, in an aqueous solution of a polymeric binder.

2. The composition of claim 1 wherein metal powder is nickel.

3. The composition of claim 2 consisting essentially of a dispersion or suspension of nickel powder in an aqueous solution of a polymeric binder.

4. The composition of claim 2 consisting essentially of a dispersion or suspension of graphite powder in an aqueous solution of a polymeric binder.

5. The composition of claim 2 wherein the polymeric binder is polyvinyl alcohol.

6. The composition of claim 2 further comprising a viscosity modifier and an anti-bacterial agent.

* * * * *